US006312242B1

(12) United States Patent
Fang et al.

(10) Patent No.: US 6,312,242 B1
(45) Date of Patent: Nov. 6, 2001

(54) ASYMMETRIC DOUBLE SCREW ROTOR ASSEMBLY

(75) Inventors: Hong-Sheng Fang; Chun-chien Chen; Ming-Hsin Liu, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/639,943

(22) Filed: Aug. 17, 2000

(30) Foreign Application Priority Data

May 12, 2000 (TW) ..... 89207951

(51) Int. Cl.[7] ..... F01C 1/16
(52) U.S. Cl. ..... 418/201.1; 418/194
(58) Field of Search ..... 418/194, 201.1

(56) References Cited

U.S. PATENT DOCUMENTS 2,939,745 * 6/1960 Carlsmith et al. ..... 418/194
3,814,557 * 6/1974 Volz ..... 418/197
5,667,370 * 9/1997 Im ..... 418/201.1
6,176,694 * 1/2001 Fang et al. ..... 418/194

FOREIGN PATENT DOCUMENTS

384355-A * 12/1932 (GB) ..... 418/194
01-237384-A * 9/1989 (JP) ..... 418/9
1437575-A * 11/1988 (SU) ..... 418/194

* cited by examiner

*Primary Examiner*—Thomas Denion
*Assistant Examiner*—Theresa Trieu
(74) *Attorney, Agent, or Firm*—Rabin & Berdo, P.C.

(57) ABSTRACT

An asymmetric double screw rotor assembly includes two asymmetric screw rotors respectively revolvably meshed together in a casing having an inlet and an outlet, the spiral threads of the screw rotors defining an uniform pitch, the outer diameter of the first screw rotor and the inner root diameter of the second rotor being uniform, the inner root diameter of the first screw rotor gradually increased from the inlet of the casing toward the outlet, the outer diameter of the second screw rotor gradually reduced from the inlet of the casing toward the outlet. Upon respective rotary motion of the screw rotors, the volume of the respective air chambers gradually reduces from the inlet of the casing toward the outlet.

11 Claims, 6 Drawing Sheets

ASYMMETRIC DOUBLE SCREW ROTOR ASSEMBLY

BACKGROUND OF THE INVENTION

The present invention relates to fluid machinery for controlling a fluid pressure, and more particularly to a double screw rotor assembly for use in a vacuum pump, air compressor, water or oil pump, or any of a variety of fluid media to regulate the pressure of a fluid passing through.

FIG. 1 shows a double screw rotor assembly constructed according to U.S. Pat. No. 5,667,370 discloses another structure of double screw rotor assembly. According to this design, the meshed screw rotors 83 and 84 have same tooth height H", and the pitch is made gradually reduced in direction from the input side toward the output end 801 ($P_1>P_2$). Because of $P_1>P_2$, the volume of air chamber 830 or 840 is getting smaller during transmission, causing pressure to be relatively increased. Therefore, when compressed and transmitted to the output end 801, less pressure difference occurs on the output end, preventing a reverse flow of air and high noise. However, because of different pitches and pressure angles are defined at different elevations, the fabrication process of the screw rotors 83 and 84 is complicated, resulting in a high manufacturing cost.

FIG. 2 shows still another structure of double screw rotor assembly, which was filed by the present applicant under U.S. application Ser. No. 09/372,674. According to this design, two symmetric screw rotors 91 and 92 are meshed together and mounted in a compression chamber inside a casing, each comprising a spiral thread around the periphery. The thread has a tooth height H made gradually reduced from the input side 901 toward the output end 90. The threads of the screw rotors 91 and 92 define an uniform pitch P. The volumes of the air chambers 910 and 920 reduce gradually from the input side 901 toward the output end 90, so that pressure can be gradually increased during the transmission process, preventing a high consumption of power and high noise. Because an uniform pitch P is provided and the height H is made gradually reduced from the input side 901 toward the output side 90, the outer diameter D has the shape of an invertedly disposed cone, and the inner root diameter d has the shape of a regular cone. This design complicates the fabrication of the rotors 91 and 92.

SUMMARY OF THE INVENTION

The present invention has been accomplished to provide an asymmetric double screw rotor assembly, which eliminates the aforesaid drawbacks. It is main object of the present invention to provide an asymmetric double screw rotor assembly, which is easy and inexpensive to b e manufactured. According to the present invention, the asymmetric double screw rotor assembly comprises a casing, the casing having an inside wall defining a receiving chamber, an inlet, and an outlet, and two screw rotors meshed together and mounted in the receiving chamber inside the bushing. The screw rotors include a first screw rotor and a second screw rotor. The first screw rotor and the second screw rotor each have at least one spiral thread raised around the respective periphery. The tooth tip of the at least one spiral thread of each screw rotor defines an outer diameter disposed in contact with the inside wall of the casing. Each spiral thread of each screw rotor has two side walls. A root of tooth of each spiral thread of each screw rotor defines an inner root diameter. The at least one spiral thread of each screw rotor defines a pitch, and defines with the inside wall of the casing at least one air chamber in the respective pitch. The outer diameter of the first screw rotor and the inner root diameter of the second screw rotor are uniform. The inner root diameter of the first screw rotor gradually increases from the inlet of the casing toward the outlet. The outer diameter of the second screw rotor reduces gradually in direction from the inlet of the casing toward the outlet. Based on the aforesaid design, the fabrication of the first screw rotor and the second screw rotor is easy and inexpensive. The inner root diameter of the first screw rotor can be made linearly increased in direction from the inlet of the casing toward the outlet, and the outer diameter of the second screw rotor can be made linearly reduced in direction from the inlet of the casing toward the outlet. Alternatively, the inner root diameter of the first screw rotor and the outer diameter of the second screw rotor can be increased or reduced non-linearly, for example, curved inwards or outwards.

DETAILED DESCRIPTION OF THE PREFERRED EMBODIMENT

Figure 1:
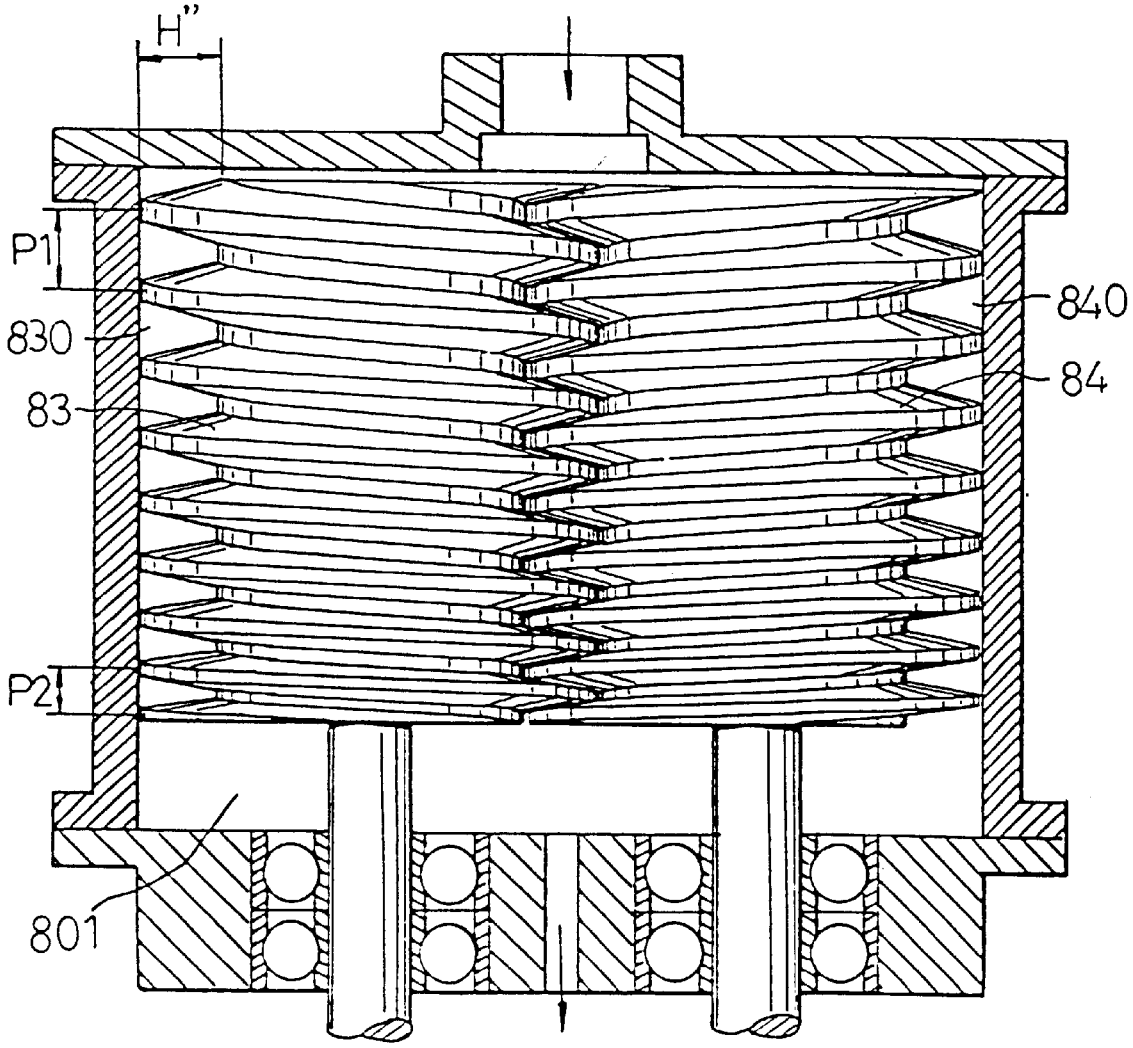
Fig. 1 (PRIOR ART)
FIG. 1 is a sectional view of a double screw rotor assembly according to the prior art.
Figure 2:
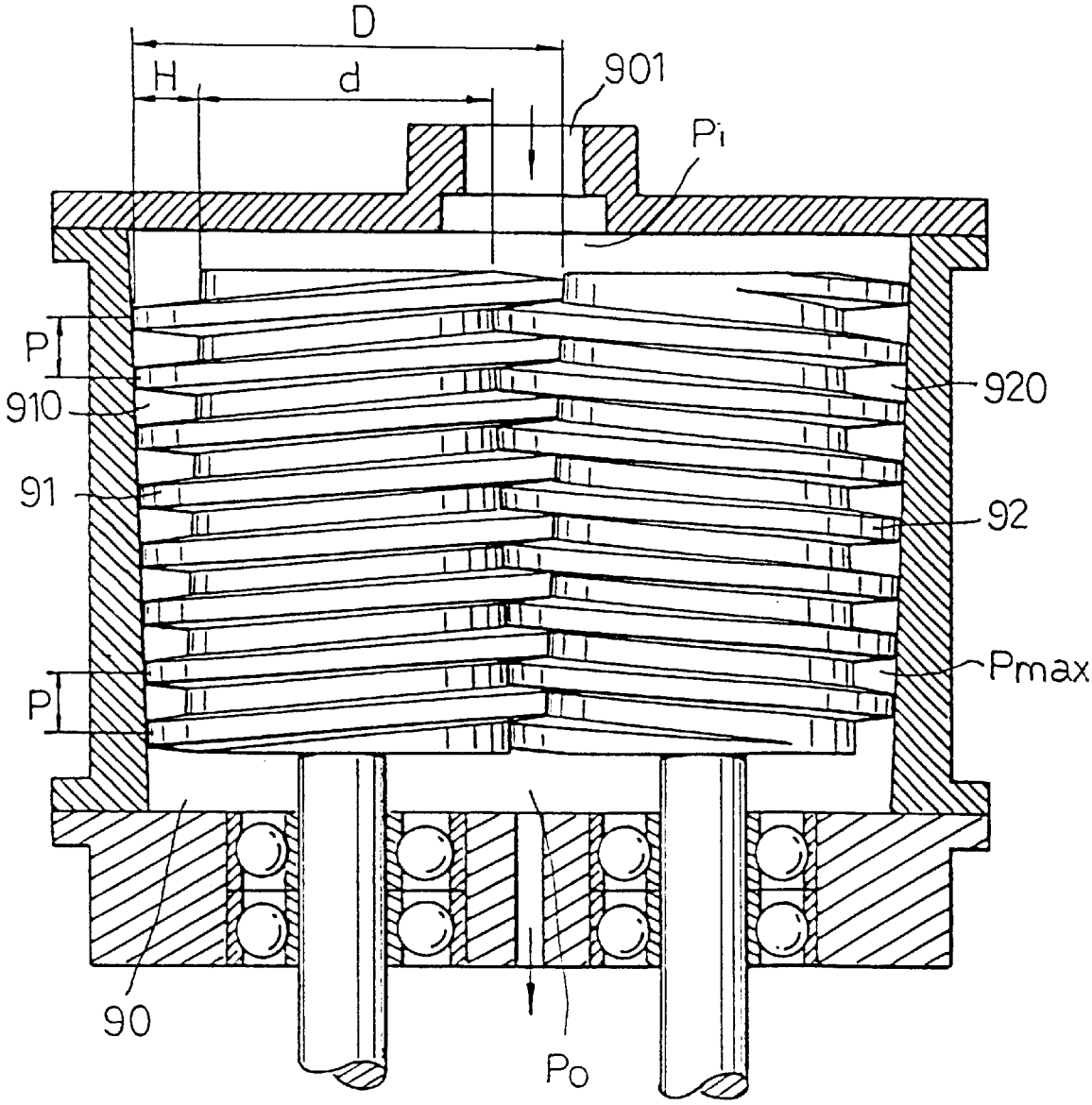
Fig. 2 (PRIOR ART)
FIG. 2 is a sectional view of another structure of double screw rotor assembly according to the prior art.
Figure 3:
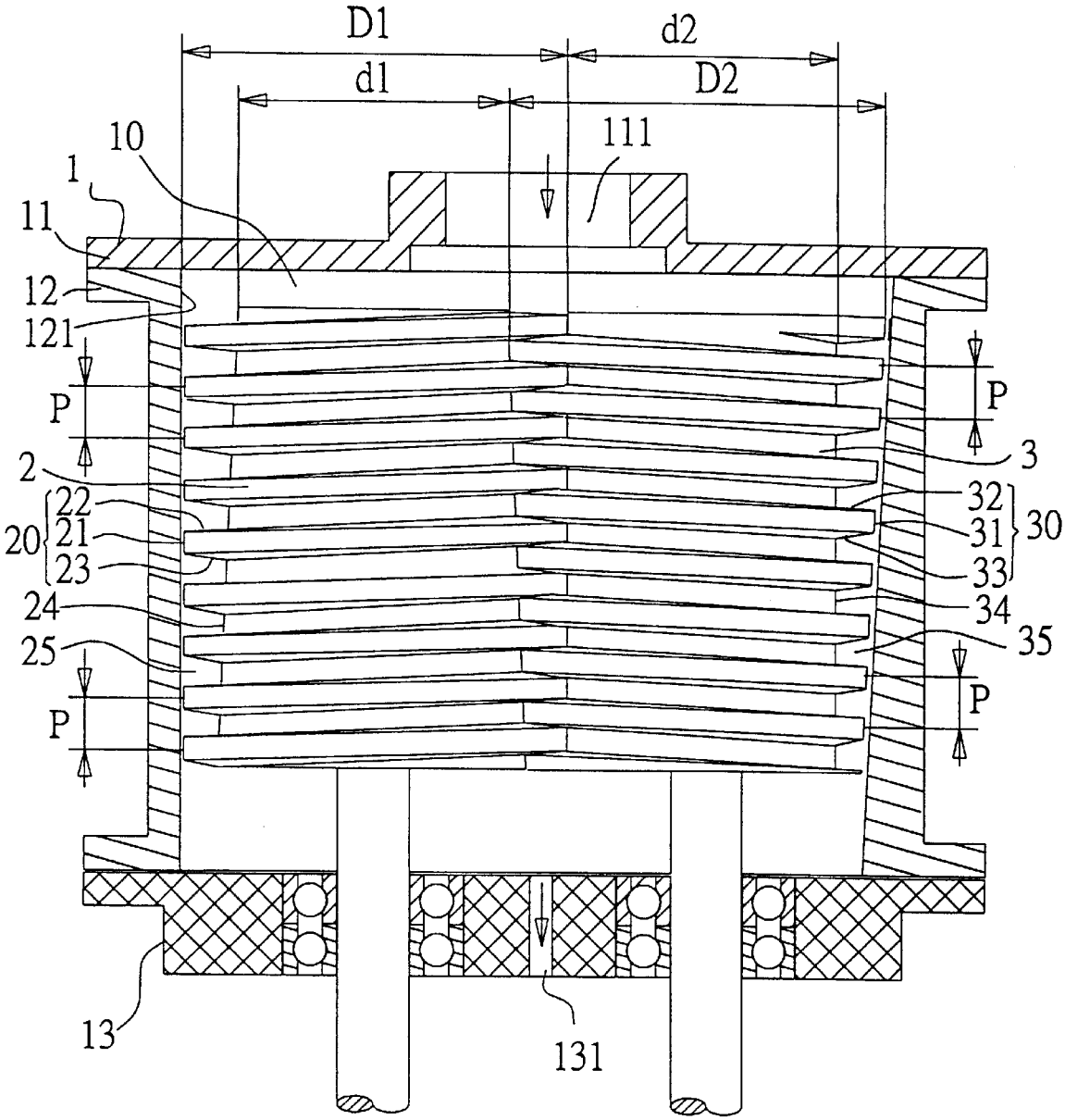
FIG. 3 is a sectional view of an asymmetric double screw rotor assembly according to the present invention.

Referring to FIG. 3, an asymmetric double screw rotor assembly according to a first embodiment of the present invention is shown for use in a vacuum pump, comprised of a casing 1, a first screw rotor 2, and a second screw rotor 3.

The casing 1 comprises a top cover 11, a peripheral shell 12 , and a bottom cover 13. The t op cover 11 has an inlet 111 connected to a container to be pump down to a vacuum circumstance. The peripheral shell 12 comprises an inside wall 121 defining a receiving chamber 10. The bottom cover 13 comprises an outlet 131 disposed in communication with the atmosphere.

The first screw rotor 2 and the second screw rotor 3 are meshed together, and mounted inside the receiving chamber 10 in the casing 1. The screw rotor 2 or 3 comprises a spiral thread 20 or 30 raised a round the periphery (Alternatively, the screw rotors 2 and 3 can be made having two or more threads). The tooth tip 21 or 31 of the thread 20 or 30 of the screw rotor 2 or 3 is spirally extended, defining an outer diameter D1 or D2, which is disposed in contact with the inside wall 121 of the peripheral shell 12 of the casing 1. The thread 20 or 30 has two side walls 22 and 23, or, 32 and 33. The root of tooth 24 or 34 of the thread 20 or 30 defines an inner root diameter d1 or d2. The thread 20 or 30 defines an uniform pitch P, and also defines with the inside wall 121 of the peripheral shell 12 of the casing 1 a plurality of air chambers 25 or 35 in the respective pitch P.

As illustrated, the outer diameter D1 of the first screw rotor 2 is uniform and engaged with the uniform inner root diameter d2 of the second screw rotor 3, the inner root diameter d1 of the first screw rotor 2 is engaged with the outer diameter D2 of the second screw rotor 3, the inner root diameter d1 of the first screw rotor 2 gradually linearly increases from the inlet 111 of the casing 1 toward the outlet 131 of the casing 1 (showing the shape of a regular cone), and the outer diameter D2 of the second screw rotor 3 gradually linearly reduces from the inlet 111 of the casing 1 toward the outlet 131 thereof (showing the shape of an invertedly disposed regular cone). When the first screw rotor 2 and the second screw rotor 3 are meshed together and rotated, the volume of the respective air chambers 25 and 35 gradually reduces from the inlet 111 of the casing 1 toward the outlet 131 thereof.

Figure 4:
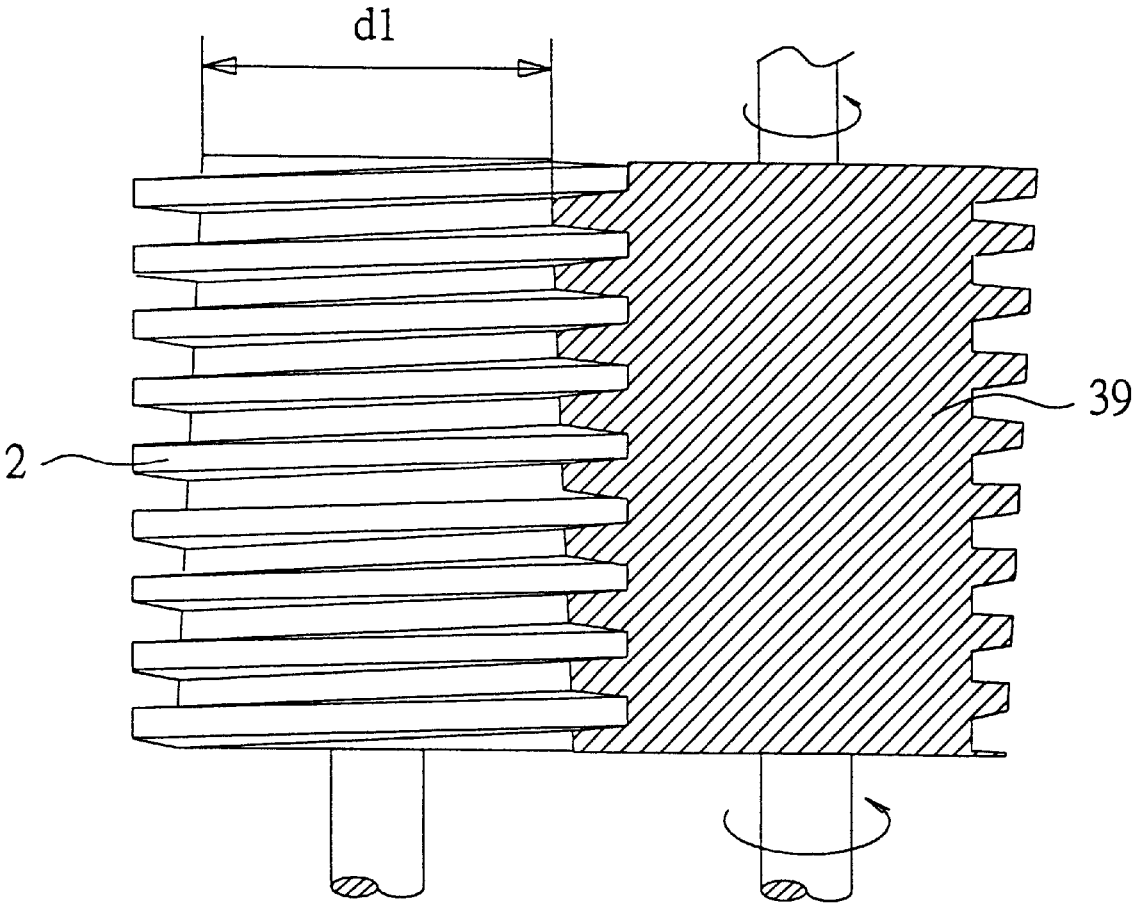
FIG. 4 is a schematic drawing showing the processing of the first screw rotor according to the present invention.

FIG. 4 is a schematic drawing showing the processing of the first screw rotor according to the present invention. At first, a hob cutter 39 is prepared having the shape identical to the second screw rotor 3 (the inner root diameter of the hob cutter 39 shows a cylindrical shape, suitable for processing by a machine), and then using the hob cutter 39 to cut the first screw rotor 2. By means of the application of the hob cutter 39, the conical inner root diameter d1 of the first screw rotor 2 can easily be processed. Because the inner root diameter d2 of the second screw rotor 3 has a cylindrical shape, it is easy to be processed the second screw rotor 3 with a machine. As indicated, the invention simplifies the fabrication of the first and second screw rotors. Because the fabrication of the first and second screw rotors is easy, the manufacturing cost of the asymmetric double screw rotor assembly is low.

Figure 5:
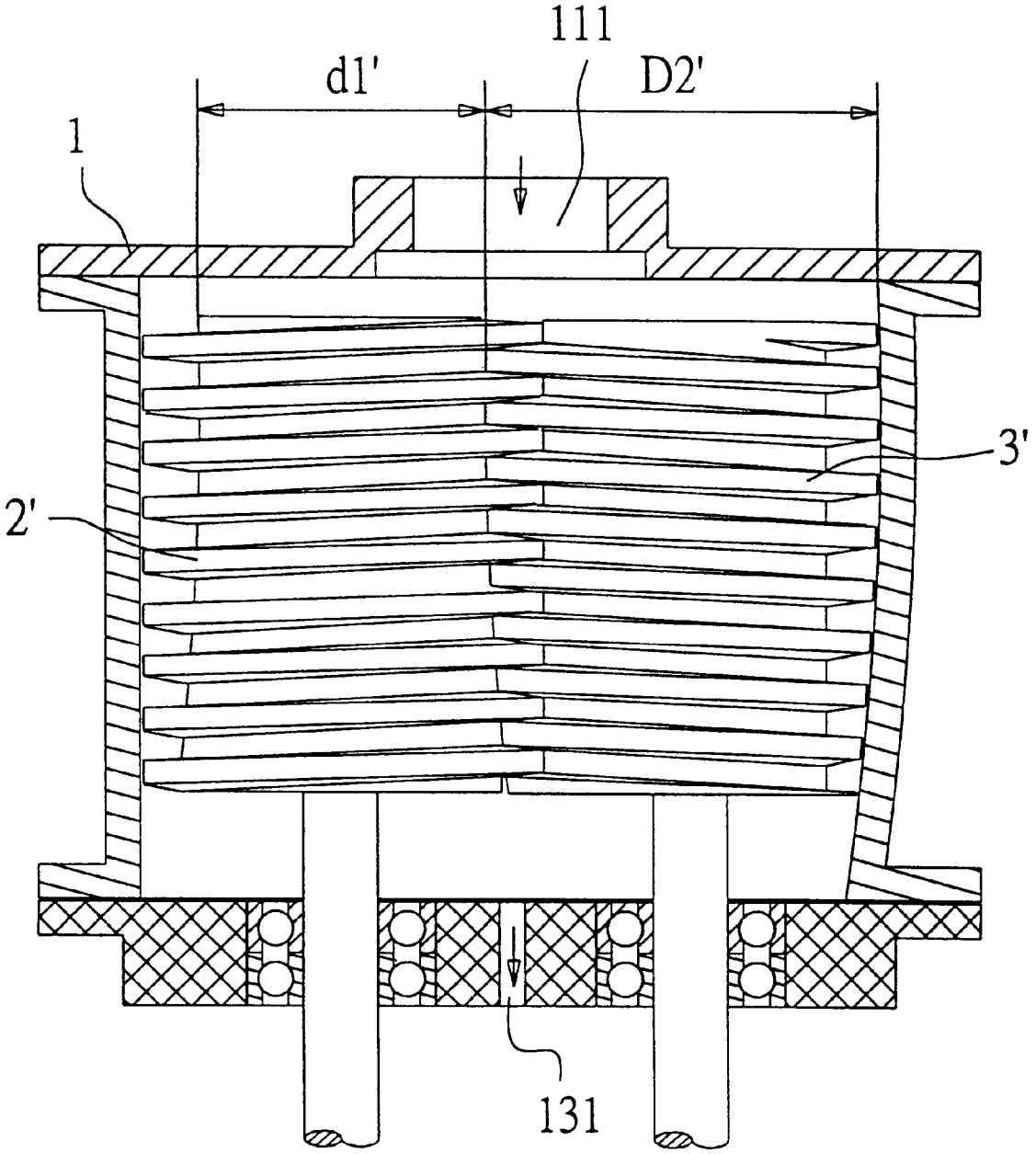
FIG. 5 is a sectional view of an alternate form of the asymmetric double screw rotor assembly according to the present invention.

FIG. 5 shows an alternate form of the asymmetric double screw rotor assembly according to the present invention. The structure of this alternate form is substantially similar to the aforesaid first embodiment of the present invention. However, according to this alternate form, the inner root diameter d1' of the first screw rotor 2' curves inwards in direction from the inlet 111 of the casing 1 toward the outlet 131 thereof, and the outer diameter D2' of the second screw rotor 3' curves outwards in direction from the inlet 111 of the casing 1 toward the outlet 131 thereof.

Figure 6:
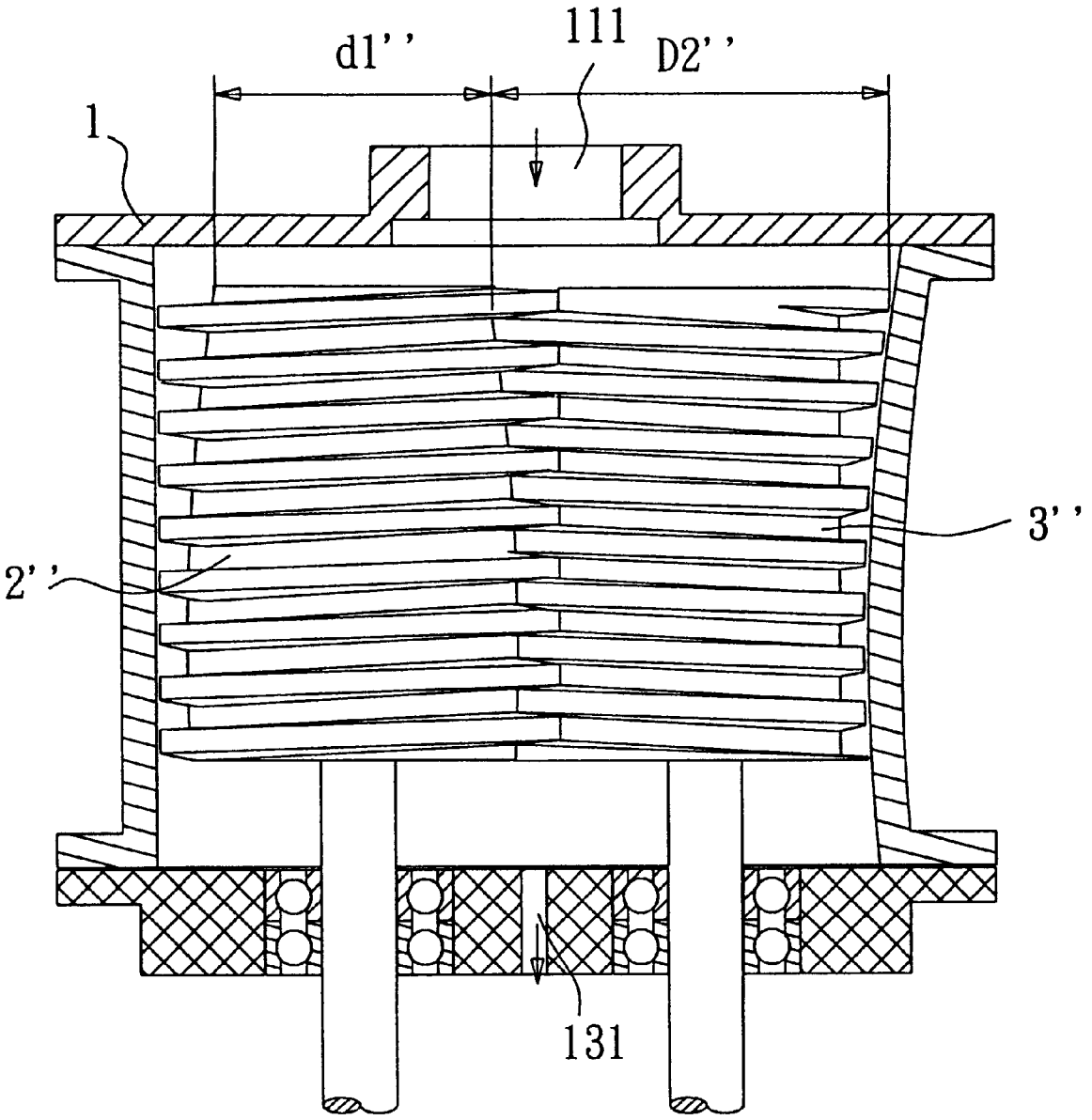
FIG. 6 is sectional view of another alternate form of the asymmetric double screw rotor assembly according to the present invention.

FIG. 6 shows another alternate form of the asymmetric double screw rotor assembly according to the present invention. According to this alternate form, the inner root diameter d1" of the first screw rotor 2" curves outwards in direction from the inlet 111 of the casing 1 toward the outlet 131 thereof, and the outer diameter D2" of the second screw rotor 3" curves inwards in direction from the inlet 111 of the casing 1 toward the outlet 131 thereof.

It is to be understood that the drawings are designed for purposes of illustration only, and are not intended for use as a definition of the limits and scope of the invention disclosed.

What the invention claimed is:

1. An asymmetric double screw rotor assembly comprising:

a casing, said casing comprising an inside wall defining a receiving chamber, an inlet and an outlet respectively disposed in communication with the receiving chamber of said casing; and two screw rotors meshed together and mounted in the receiving chamber inside said bushing; said screw rotors including a first screw rotor and a second screw rotor, said first screw rotor and said second screw rotor each having at least one spiral thread raised around the respective periphery, the tooth tip of the at least one spiral thread of each of said screw rotors defining an outer diameter disposed in contact with the inside wall of said casing, each spiral thread of each of said screw rotors having two side walls, a root of tooth of each spiral thread of each of said screw rotors defining an inner root diameter, the at least one spiral thread of each of said screw rotors defining a pitch, and defining with the inside wall of said casing at least one air chamber in the respective pitch;

wherein the outer diameter of said first screw rotor and the inner root diameter of said second screw rotor are uniform, the inner root diameter of said first screw rotor gradually increases from the inlet of said casing toward the outlet of said casing, and the outer diameter of said second screw rotor reduces gradually in direction from the inlet of said casing toward the outlet of said casing.

2. The asymmetric double screw rotor assembly of claim 1 wherein the pitch defined by the at least one thread of each of said screw rotors is uniform.

3. The asymmetric double screw rotor assembly of claim 1 wherein the inner root diameter of said first screw rotor increases gradually linearly in direction from the inlet of said casing toward the outlet of said casing.

4. The asymmetric double screw rotor assembly of claim 1 wherein the inner root diameter of said first screw rotor increases non-linearly in direction from the inlet of said casing toward the outlet of said casing.

5. The asymmetric double screw rotor assembly of claim 4 wherein the inner root diameter of said first screw rotor curves inwards in direction from the inlet of said casing toward the outlet of said casing.

6. The asymmetric double screw rotor assembly of claim 4 wherein the inner root diameter of said first screw rotor curves outwards in direction from the inlet of said casing toward the outlet of said casing.

7. The asymmetric double screw rotor assembly of claim 1 wherein the outer diameter of said second screw rotor reduces linearly in direction from the inlet of said casing toward the outlet of said casing.

8. The asymmetric double screw rotor assembly of claim 1 wherein the outer diameter of said second screw rotor reduces non-linearly in direction from the inlet of said casing toward the outlet of said casing.

9. The asymmetric double screw rotor assembly of claim 8 wherein the outer diameter of said second screw rotor curves outwards in direction from the inlet of said casing toward the outlet of said casing.

10. The asymmetric double screw rotor assembly of claim 8 wherein the outer diameter of said second screw rotor curves inwards in direction from the inlet of said casing toward the outlet of said casing.

11. The asymmetric double screw rotor assembly of claim 1 wherein said casing is comprised of a peripheral shell, a top cover, and a bottom cover.

* * * * *